US011998075B2

(12) United States Patent
Taylor-Knop

(10) Patent No.: US 11,998,075 B2
(45) Date of Patent: Jun. 4, 2024

(54) PROSTHETIC EYELASH HOLDER

(71) Applicant: SrahBee LLC, Peyton, CO (US)

(72) Inventor: Melissa Erin Taylor-Knop, Peyton, CO (US)

(73) Assignee: SRAHBEE LLC, Peyton, CO (US)

( * ) Notice: Subject to any disclaimer, the term of this patent is extended or adjusted under 35 U.S.C. 154(b) by 763 days.

(21) Appl. No.: 17/177,815

(22) Filed: Feb. 17, 2021

(65) Prior Publication Data

US 2021/0259339 A1 Aug. 26, 2021

Related U.S. Application Data

(60) Provisional application No. 62/979,211, filed on Feb. 20, 2020.

(51) Int. Cl.
*A45D 44/04* (2006.01)
*A41G 5/02* (2006.01)
*A45D 44/16* (2006.01)

(52) U.S. Cl.
CPC ..... *A41G 5/02* (2013.01); *A45D 44/16* (2013.01)

(58) Field of Classification Search
CPC ..... A45C 11/008; A41G 5/02; A45D 44/04; A45D 2/48
See application file for complete search history.

(56) References Cited

U.S. PATENT DOCUMENTS 2,827,689 A * 3/1958 Shoffner ..... A44C 27/00 269/254 R
2022/0132967 A1* 5/2022 Pflug ..... A45D 44/00 132/201

* cited by examiner

*Primary Examiner* — Rachel R Steitz
*Assistant Examiner* — Brianne E Kalach
(74) *Attorney, Agent, or Firm* — Jack F. Stuart, II; Michael C. Martensen; Martensen IP

(57) ABSTRACT

The invention features a holder for prosthetic eyelashes comprising a clamp having two jaws and a closure linkage designed to retain and convey the two jaws in and between an open conformation and a closed conformation. Each jaw has one or more articulated linkages, with the articulated linkages being designed to permit adjustment of a jaw curvature conforming to a desired curvature of a prosthetic eyelash. The two jaws provide rigidity in a dimension for permitting an application of clamping force against the prosthetic eyelash. A spring is fixedly attached to each of the two jaws, and the spring is biased to urge the jaws into the closed conformation. A stand may be attached to the spring, with the stand being designed to hold the clamp in a working position for retention of the prosthetic eyelash for preparation of application to a human eyelid.

20 Claims, 8 Drawing Sheets

PROSTHETIC EYELASH HOLDER

This application is a non-provisional of and claims priority to U.S. Provisional App. Ser. No. 62/979,211, filed Feb. 20, 2020, which is incorporated by reference.

BACKGROUND

Embodiments of the present invention relate, in general, to cosmetic-related tools and more particularly to holders for prosthetic eyelash.

SUMMARY

In general, in a first aspect, the invention features a holder for prosthetic eyelashes that comprises a base, and the base has a DC power source, a power on/off switch, a mirror, a light, a timer, a timer display, and a speaker. The power on/off switch includes an on setting and an off setting, in which the on setting permits the power source to power each of the light, the timer, the timer display and the speaker. Removably attached to the base is a support rod, and the support rod has an adjustable length. Fixedly attached to the support rod is a swivel segment having a first end and a second end, in which the swivel segment is fixedly attached to the support rod at the first end. Removably attached to the swivel segment at the second end is a spring. A clamp is fixedly attached to the spring and the clamp has two jaws and a closure linkage. The closure linkage is designed to retain and convey the jaws in and between an open conformation and a closed conformation. Further, each of the two jaws includes one or more articulated linkages, permitting adjustment of a jaw curvature to conform to a desired curvature of a prosthetic eyelash. The two jaws provide rigidity in a dimension permitting application of clamping force against the prosthetic eyelash, and the spring is biased to urge the jaws into the closed conformation.

In general, in a second aspect, the invention features a holder for prosthetic eyelashes that comprises a clamp having two jaws, as well as a closure linkage designed to retain and convey the two jaws in and between an open conformation and a closed conformation. Each of the two jaws has one or more articulated linkages, with the articulated linkages being designed to permit adjustment of a jaw curvature conforming to a desired curvature of a prosthetic eyelash. Further, the two jaws provide rigidity in a dimension for permitting an application of clamping force against the prosthetic eyelash. A spring is fixedly attached to each of the two jaws, and the spring is biased to urge the jaws into the closed conformation. A stand is attached to the spring, with the stand being designed to hold the clamp in a working position for retention of the prosthetic eyelash for preparation of application to a human eyelid.

In general, in a third aspect, the invention features a method for holding prosthetic eyelashes comprising associating a prosthetic eyelash with a clamp, in which the clamp has two jaws and a closure linkage designed to retain and convey the two jaws in and between an open conformation and a closed conformation. Each of the two jaws has one or more articulated linkages, the articulated linkages designed to permit adjustment of a jaw curvature conforming to a desired curvature of a prosthetic eyelash. The two jaws further provide rigidity in a dimension for permitting an application of clamping force against the prosthetic eyelash. The method further comprises urging the two jaws into the closed conformation with a spring biased to apply a closing force; and attaching the spring to a stand, the stand designed for positioning the clamp into a working position for preparation of the prosthetic eyelash for application to a human eyelid.

Embodiments of the invention may include one or more of the following features. These features may be used singly, or in combination with each other. Each of the one or more articulated linkages in each clamp jaw may be a disc-detent joint. The stand may further comprise a base and a support rod, the base having a DC power source, a power on/off switch, a mirror, a light, a timer, a timer display, and a speaker. The power on/off switch may include an on setting and an off setting, in which the on setting permits the power source to power each of the light, the timer, the timer display and the speaker. The stand may further comprise a swivel segment having a first end and a second end, in which the swivel segment is fixedly attached to the support rod at the first end. The swivel segment may further comprise one or more ball joints, wherein the support rod is fixedly attached to one of the one or more ball joints. The base may further comprise either a drawer or a battery. The DC power source may be an AC-to-DC adaptor connected to an external AC power source, or the DC power source may be the battery. The support rod may be removably attached to the base and have an adjustable length. The support rod may be magnetically removably attached to the base and the swivel segment may be removably or magnetically removably attached to the spring. The spring may be fixedly attached to the stand or magnetically removably attached to the stand.

The above advantages and features are of representative embodiments only and are not all-inclusive. They are presented only to assist in understanding the invention, thus they are not to be considered limitations on the invention as defined by the claims. Novel features and additional advantages of the invention will become apparent from the description, the drawings, and the claims. Many of these features will also become apparent to those skilled in the art upon examination of the following specification or may be learned through practice of the invention.

DESCRIPTION OF THE DRAWINGS

The aforementioned and other features and objects of the present invention and the manner of attaining them will become more apparent, and the invention itself will be best understood, by reference to the following description of one or more embodiments taken in conjunction with the accompanying drawings, wherein:

FIG. 7 is a front left perspective of the prosthetic eyelash holder.

The Figures depict embodiments of the present invention for illustration purposes only. One skilled in the art will readily recognize from the following discussion that alternative embodiments of the illustrated structures and methods may be employed without departing from the principles of the invention described.

Features and objects of the present invention and the manner of attaining them will become more apparent, and the invention itself will be best understood, by reference to the following description of one or more embodiments taken in conjunction with the accompanying drawings and figures imbedded in the text below and attached following this description.

DESCRIPTION

Overview

Figure 2:
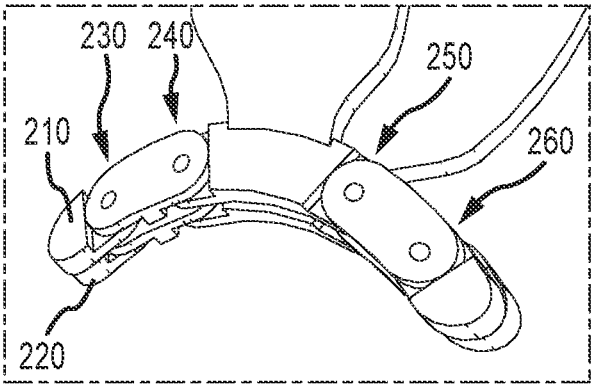
FIGS. 2, 3, and 4 are perspective views of a clamp.
Figure 3:
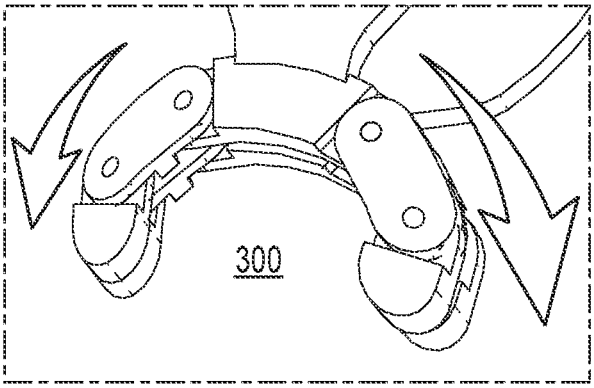
Figure 1:
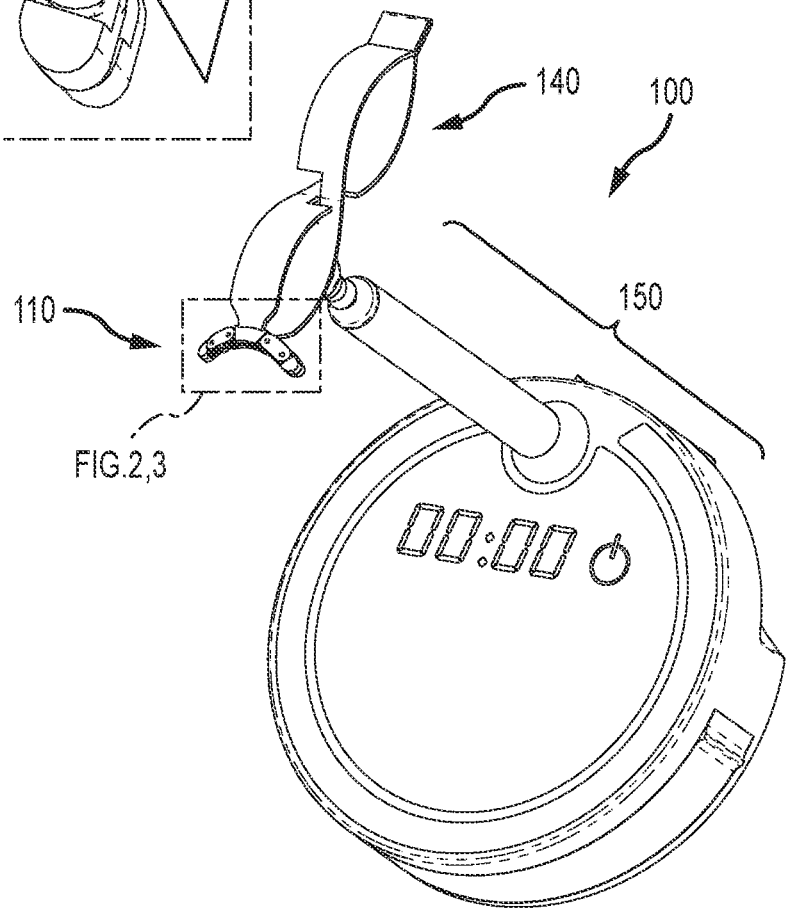
FIGS. 1 and 7 are perspective views of a holder for prosthetic eyelashes.

Referring to FIGS. 1, 2 and 3, a holder for prosthetic eyelashes, or prosthetic eyelash holder 100, may maintain a custom-contoured, secure grip on a prosthetic eyelash and provide an all-in-one eyelash holder and applicator. A prosthetic eyelash holder 100 has an eyelash clamp 110 comprised of two clamp jaws 210, 220; a spring 140, fixedly attached to the clamp jaws 210, 220, and biased to urge the jaws closed; and a stand 150. The clamp 110 itself may be designed to hold the prosthetic eyelash in place for hands-free access to the eyelash. The clamp 110 has one or more articulated linkages 230, 240, 250, 260, the purpose of which may be to enable adjustment of the curvature of each jaw of the clamp 300 to substantially conform to the curvature of a given prosthetic eyelash, to better hold the eyelash in a position to prepare its application to a human eyelid. The prosthetic eyelash holder 100 allows a user to apply any brand of eyelash glue to any brand of prosthetic eyelash while the eyelash is held in the holder's convenient, hands-free clamp 110. Each of the adjustable-curvature clamp jaws 210, 220 may attach to the spring 140, and the spring 140 constantly biases the clamp 110 into a closed position to hold the prosthetic eyelash. The adjustable linkages of each clamp jaw may permit a user to adjust the clamp jaw to substantially conform to all human eye shapes and sizes. The adjustable clamp jaws 210, 220 may enable a user to position a prosthetic eyelash on the user's eyelids with ease, allowing the user to adjust the curvature of each clamp jaw to match that of the unique shape of the particular user's eyelid.

The stand 150 itself may be further comprised of various components, each of which will be discussed below. The stand 150 may be designed attach to the spring 140 and to hold the clamp 110 in a working position for retention of a given prosthetic eyelash for preparation of application to a human eyelid.

Clamp and Spring

Referring to FIGS. 2 and 3, the clamp's jaws 210, 220 may be hypoallergenic, allowing users to apply mascara or to clean prosthetic lashes after use without having to place the eyelashes on unclean surfaces. The clamp's jaws 210, 220 and the clamp's articulated linkages 230, 240, 250, 260 may be of any composition and/or structure that balances stability with formability, from continuously-articulating, pliable materials, such as soft metals, plastics, or other compositions, to incrementally-articulating linkages. The articulating linkage may be a pivotable joint 230, 240, 250, 260, with each of clamp jaws 210, 220 having four such pivotable joints. The more linkages in each jaw, the more precise the user's control over that clamp jaw's curvature. In the extremes, no linkages would result in no ability to adjust jaw curvature; one linkage in the center of each clamp jaw would allow only a "V"-type control (i.e. the narrowing together or the widening apart of the two legs of the jaw); and an infinite number of linkages would allow infinite curvature control for each jaw. Thus each clamp jaw 210, 220 may have 1, 2, 3, 4, 5, 6, 7, 8, 9, or 10, or more linkage joints. More linkage joints allow closer curvature tracking, while fewer linkage joints would be less expensive. Adjusting the jaws' contours to substantially conform to the curvature of a given prosthetic eyelash permits the clamp 110 to better hold and support the eyelash, better enabling a user to prepare the prosthetic eyelash for application to a human eyelid, and allowing eyelash adhesive to cure, hands-free, without the mess or hassle of getting eyelash adhesive on the user's hands or other unintended surfaces.

Figure 4:
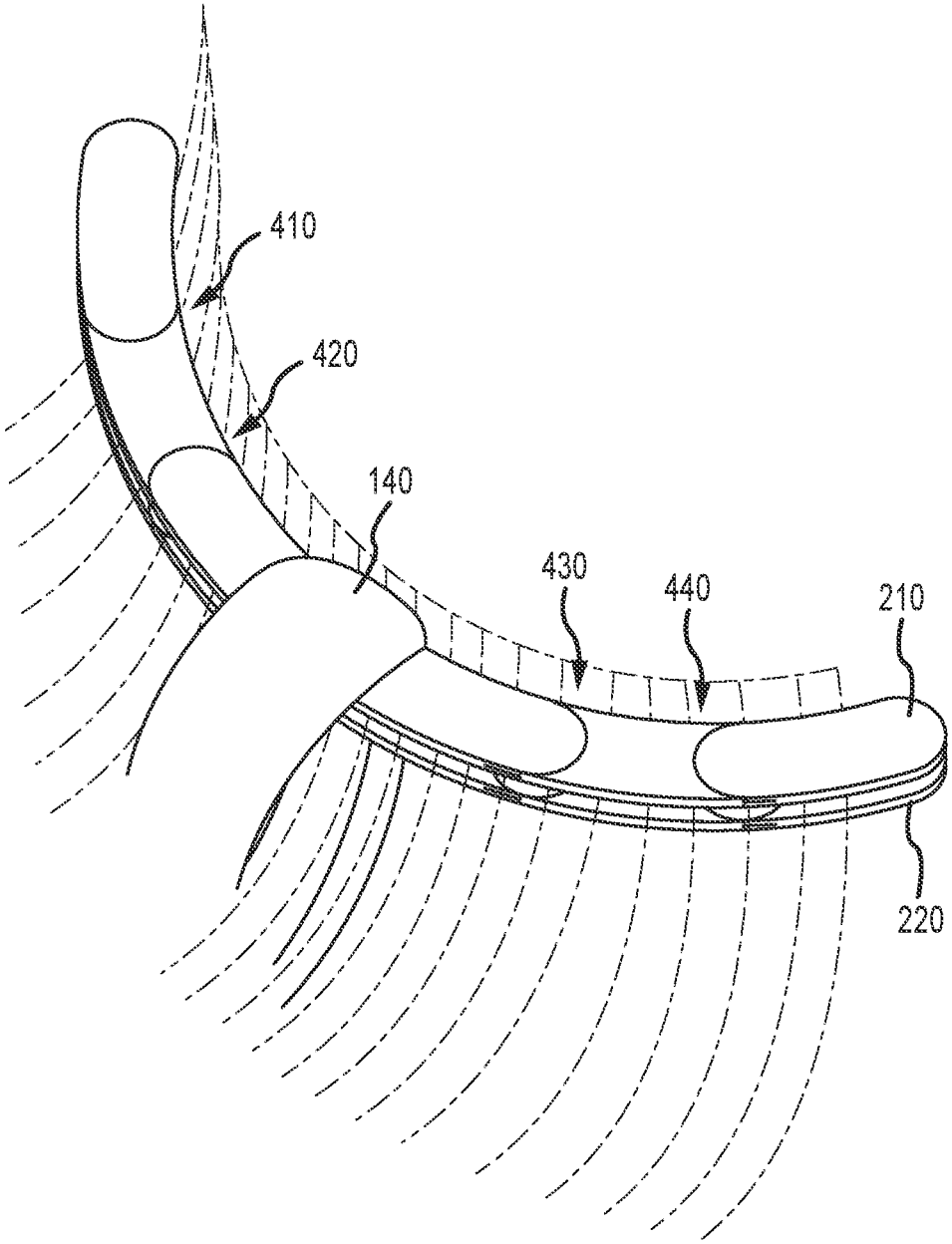
Figure 5:
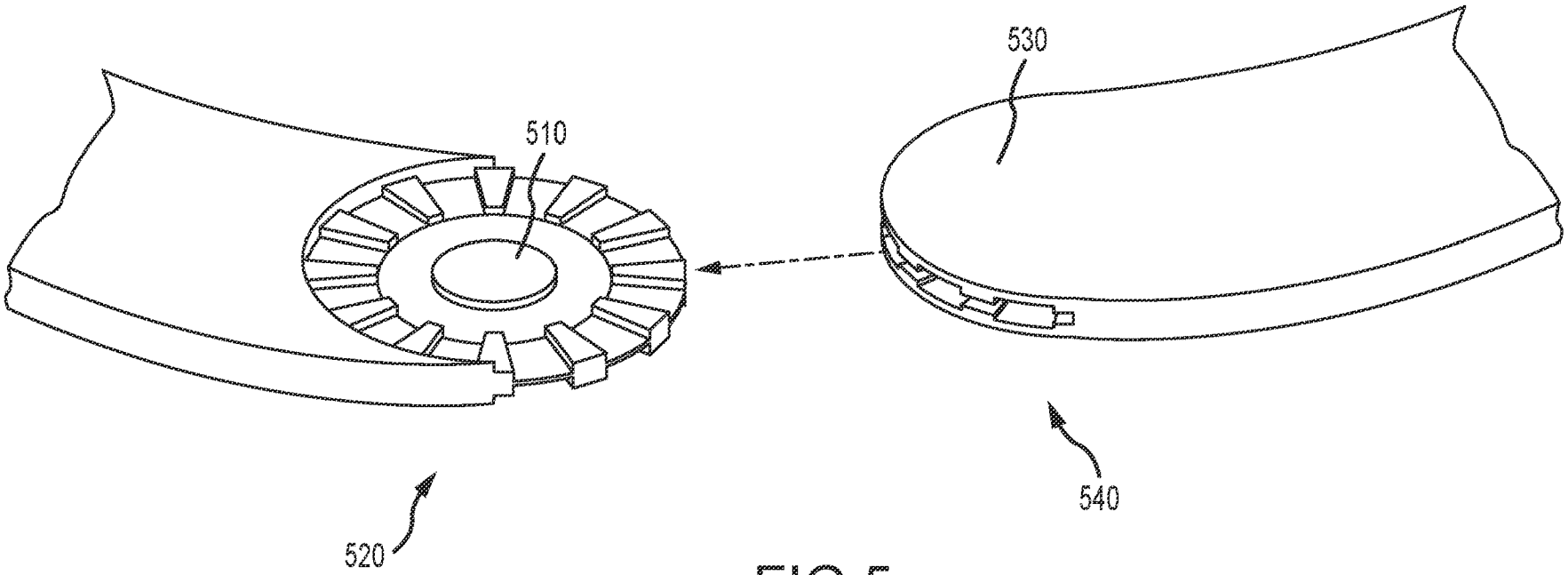
FIG. 5 is an exploded view of a clamp joint.
Figure 6:
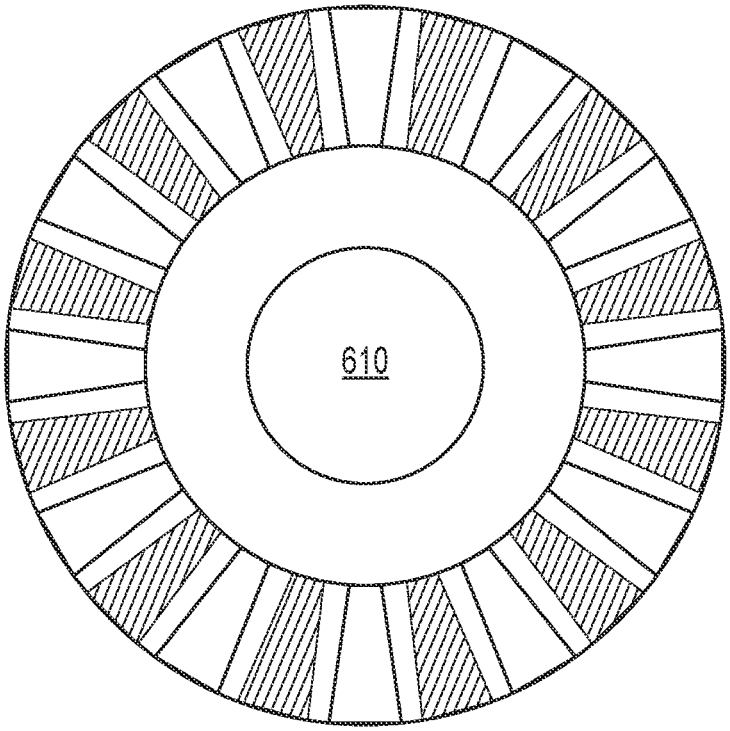
FIG. 6 is a plan view of a component of a clamp.

Referring again to FIGS. 4, 5 and 6, the articulated linkages may also be formed as a disc-detent joint 410, 420, 430, 440. The linkage may be comprised of the mating of a disc having raised portions 510 with its complementary housing 530, forming detents that limit joint positioning to discrete increments. A detented disc 510, 610 may be fixedly attached to one segment of a jaw 520, and the disc's complementary housing 530 may be fixedly attached to another segment of the same jaw 540 to form a disc-detent joint.

Referring again to FIG. 1 and FIGS. 7-12, a spring 140 may be attached to each of the clamp jaws 210, 220, and the spring 140 may be biased to urge the jaws 210, 220 closed, applying a steady pressure to hold a prosthetic eyelash securely in the clamp 110 while the user prepares the eyelash for application to the user's eyelid. The spring 140 may be a "figure-eight" type of spring 140 or it may be another design designed to apply a bias force to the clamp's jaws 210, 220 to urge the jaws 210, 220 closed together. Referring to FIG. 8, the user may squeeze the back lobe 820 of a figure-eight type spring 140 to open the clamp 110, allowing a user to place a prosthetic eyelash between the jaws 210, 220 and then to close the jaws 210, 220 by releasing force on the back lobe 820.

The spring 140 may be fixedly attached to the support rod 710 or to a swivel segment 720, or the spring 140 may be magnetically removably attached to the support rod 710 (if the swivel segment 720 is not used) or to the swivel segment 720, as further discussed, below, for ease of disassembly or for a user's use of various individual components of the prosthetic eyelash holder 100, such as the spring-clamp assembly 830 or the support rod 710 with the spring-clamp assembly 830 magnetically removably attached 710, 720, 830.

Stand—Support Rod and Swivel Segment

The stand 150 may be comprised of a support rod 710 attached to a base 730, the base 730 providing stability for the rest of the prosthetic eyelash holder 100, and the support rod 710 being attached to the spring 140 either directly, or as show in the embodiments of FIG. 1 and FIGS. 7-12, via a swivel segment 720. The stand 150 may also be further comprised of other components, including a swivel segment 720 and magnetic components 910, 920. The magnetic components 910, 920 may be comprised of magnetized steel or other magnetic material, and may be used to magnetically removably attach the support rod 710 and/or the base 730 and/or the swivel segment 720 and/or the spring 140 to other elements of the prosthetic eyelash holder 100, as detailed below, by force of magnetic attraction of the components. In this section the support rod 710 and swivel segment 720 will be discussed, in turn; the base 730 will be covered in the next section.

Figure 7:
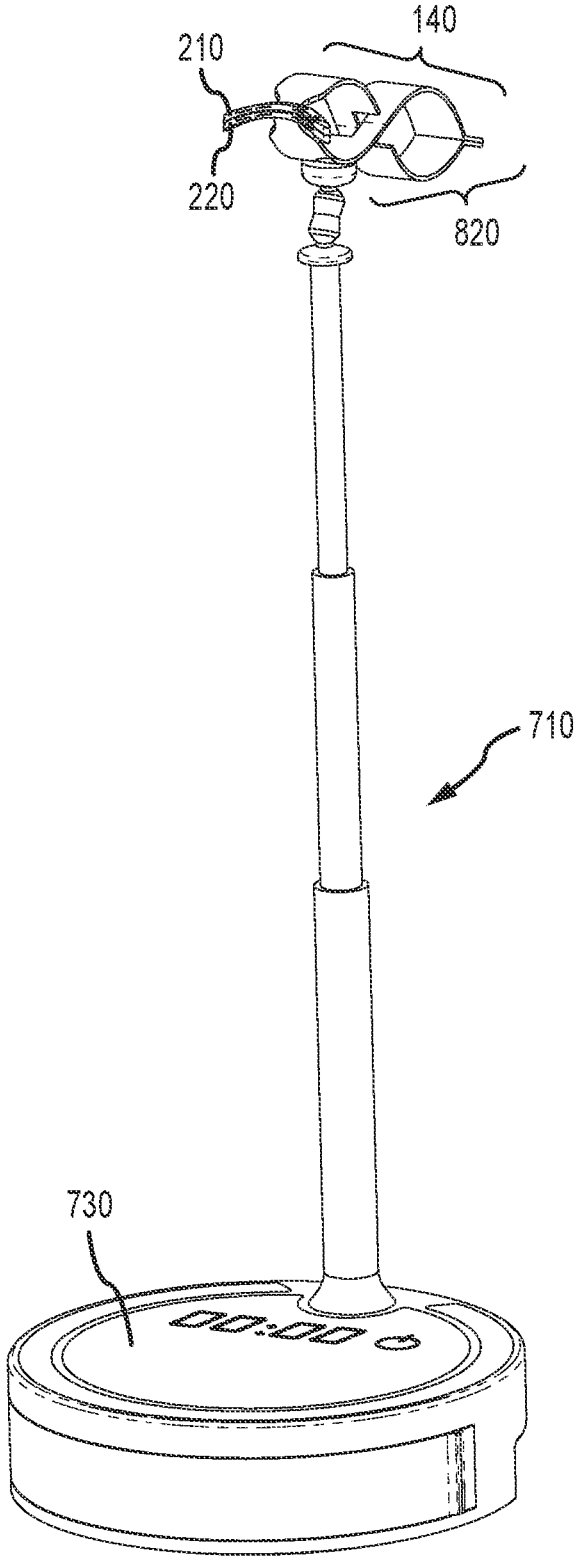
Figure 8:
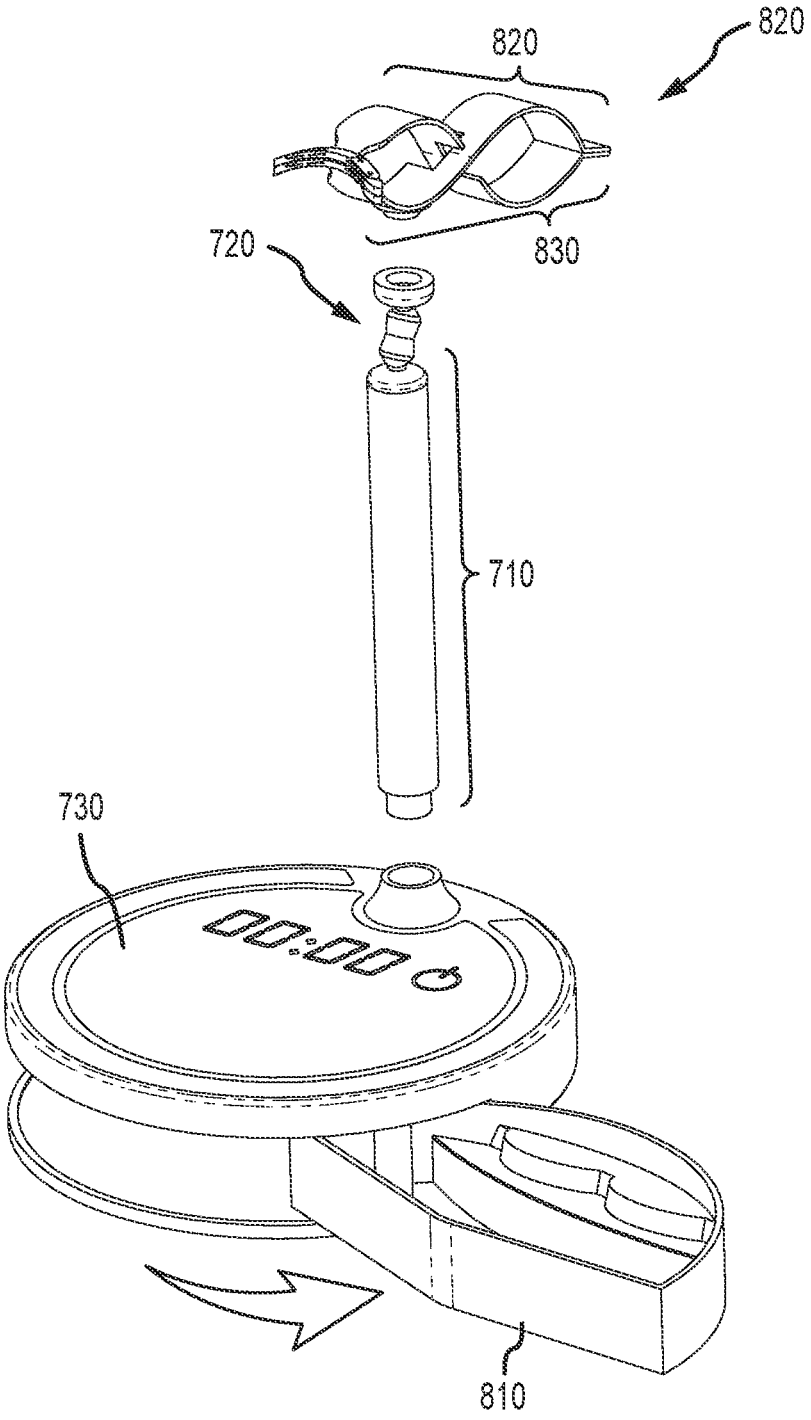
FIGS. 8 and 9 are exploded views of a holder for prosthetic eyelashes.
Figure 9:
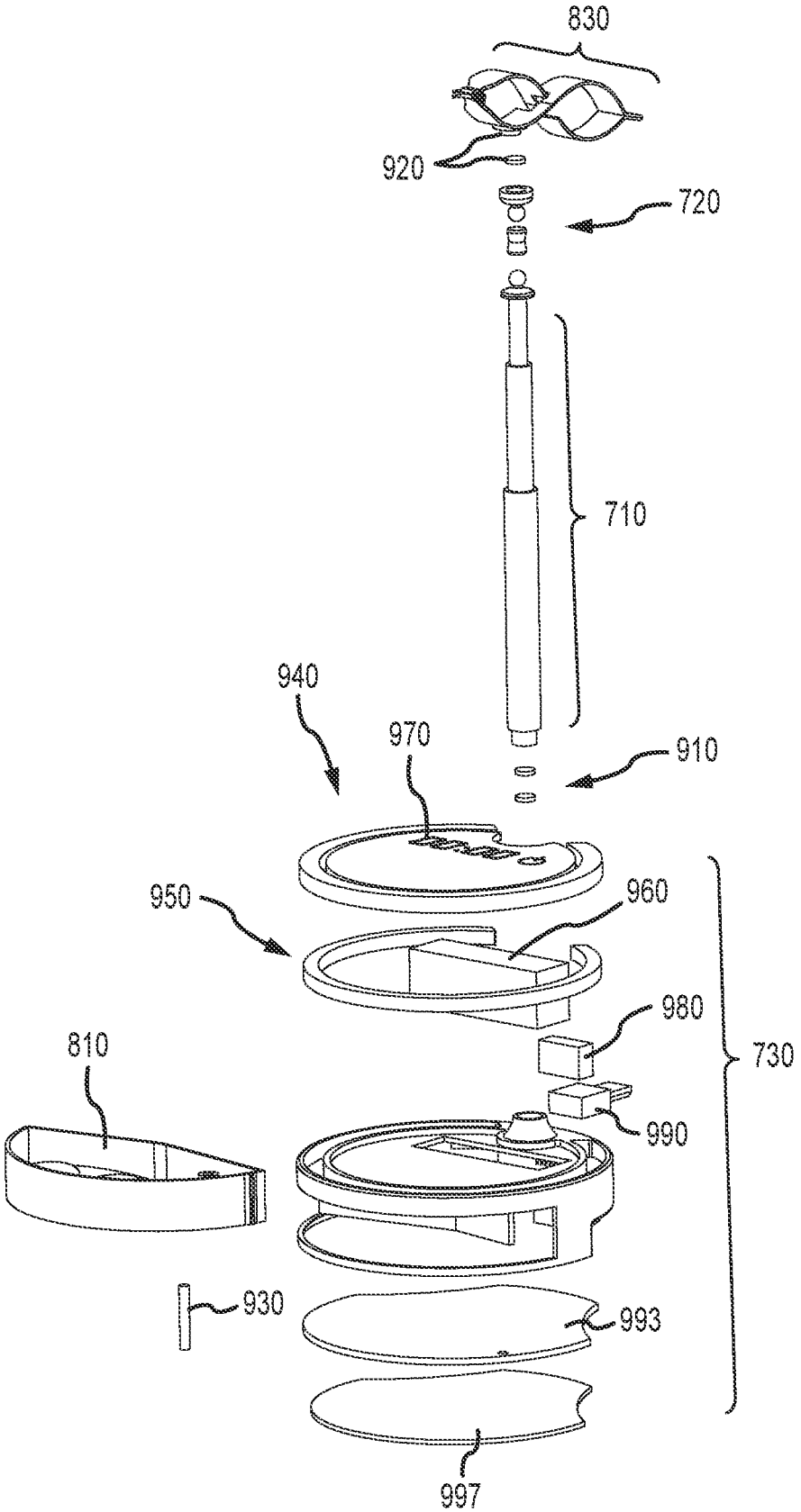
Figure 12:
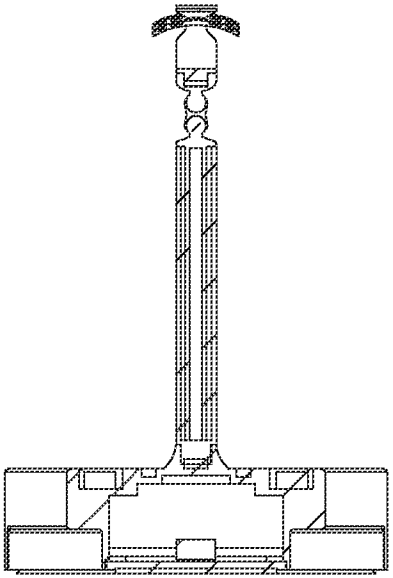
FIGS. 10, 11, and 12 are side views of the prosthetic eyelash holder.
Figure 11:
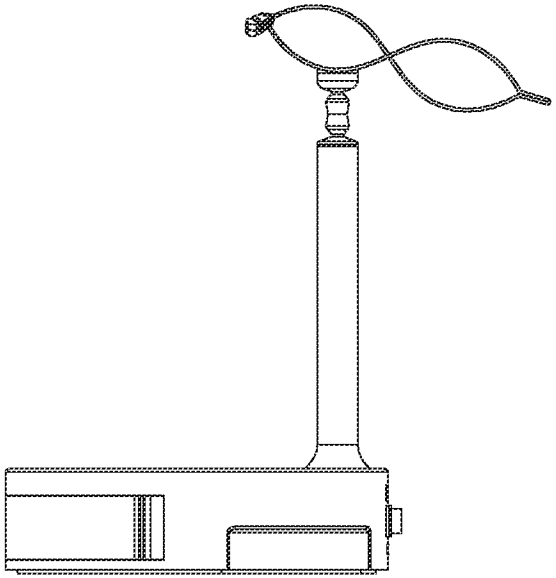
Figure 10:
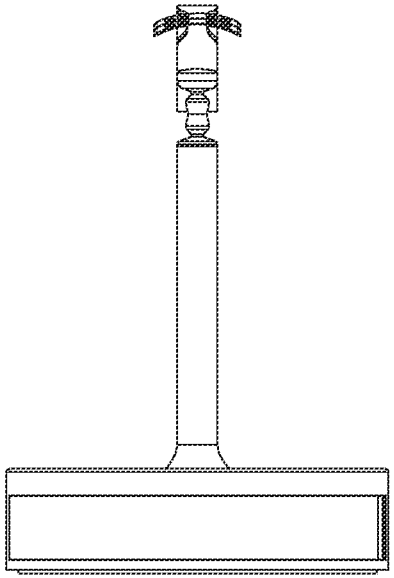

Referring to FIG. 7, the support rod 710 may be of a fixed length or it may have an adjustable length. Additionally, the support rod 710 may swivel 360 degrees around the axis through which it is mounted into the base 730, and the support rod 710 may be mounted orthogonally or non-orthogonally to the base 730. The support rod 710 may be adjustable or may have telescoping elements, allowing the support rod's length to be adjusted by the user from its shortest length with no telescoping elements extended, to its fully-extended length. The support rod 710 may be manufactured in varying lengths and/or various numbers of adjustable elements, to accommodate various users' sitting-height requirements to prepare prosthetic eyelashes on a working surface upon which the prosthetic eyelash holder 100 is placed. The support rod 710 may be fixedly attached to the base 730, or alternatively, using magnetic components 910, 920, the support rod 710 may be magnetically removably attached to the base 730 for quick disassembly or to enable a user to hold the prosthetic eyelash holder 100 without the base 730 attached. On the opposite end of the support rod 710, additional magnetic components 910, 920 may be used to magnetically removably attach the support rod 710 directly to the spring 140, the spring 140 being held to the support rod 710 through magnetic attraction of the magnetic components 910, 920.

Referring again to FIGS. 7-12, a swivel segment 720 may be fixedly attached to the end of the support rod 710 opposite the base 730, at one end of the swivel segment 720. The other end of the swivel segment 720 may be fixedly attached to the spring 140, or, alternatively, magnetically removably attached using magnetic components 910, 920, allowing a user to hold the spring-clamp assembly 830 by itself, apart from the stand 150. The swivel segment 720 may be designed to allow variable positioning of the spring 140—and thus, the clamp 110—to better enable a user to prepare a prosthetic eyelash held in the clamp 110 for application to a human eyelid. The swivel segment 720 may comprise one or more linkages to permit positioning of the clamp 110 for user convenience, allowing a prosthetic eyelash to be held by the clamp 110 in various attitudes for ease of prosthetic eyelash preparation. The linkage may be a ball joint type of linkage, with a ball joint at either end of the swivel segment 720. One ball joint may be fixedly attached to the support rod 710 and another may be magnetically removably attached to the spring 140 using magnetic components 910, 920, or the swivel segment 720 may be fixedly attached to the spring 140, if magnetic components 910, 920 are not used. In this way, the spring-clamp assembly 830 can be held by a user separately from the rest of the prosthetic eyelash holder 100 components. In another configuration, the support rod 710 can be detached from the base 730 while still being attached (either fixedly or removably) to the spring-clamp assembly 830, allowing a user to hold the support rod 710 and spring-clamp assembly 830 separately from the base 730.

Stand—Base

The base 730 may provide support and stability for the stand 150. The base 730 may also have a power on/off switch 980, a DC power source, a mirror 940, a light 950, a timer 960, a timer display 970, a speaker 960 and a drawer 810. The power on/off switch 980 may include an on setting and an off setting, and the on setting may permit the power source to power each of the light 950, the timer 960, the timer display 970 and the speaker 960. The DC power source may be external or internal. In the external configuration, an AC-to-DC adaptor may be plugged into an external AC outlet to provide DC power to a DC power receptacle 990 to power components in the base 730. The DC power receptacle 990 may be a micro-USB receptacle, or port, but other DC receptacle variants would also work, as well.

The base 730 may be Bluetooth-capable, allowing it to transmit timer 960 information to a Bluetooth-connected smartphone or speaker. Either a battery or a slidably rotatable drawer 810 may be housed in the base 730 so that the user can store various articles related to application of prosthetic eyelashes, including false-eyelash strips (i.e. prosthetic eyelashes), glue, conventional tweezers and/or cosmetic scissors. Not only can the prosthetic eyelash holder 100 be used to hold and apply prosthetic eyelashes for application, the holder can also be used to add mascara to the prosthetic eyelash, as well as clean and brush the prosthetic eyelash, while the eyelash is securely clamped in the holder.

The drawer 810 may be slidably rotatable, allowing the user to access the full contents of the drawer 810 while the drawer 810 may be nonetheless attached to the base 730 by means of a drawer axis 930. Alternatively, the drawer 810 of the base 730 may be removed and replaced with a battery to provide internal DC power to the base 730, for ease of portability—that is, without the base's having to be tethered to an external power source.

The base 730 may have an upper and lower surface. The mirror 940 may cover all or part of the upper surface of the base 730, allowing a user to view application of a prosthetic eyelash to the user's eye while holding the prosthetic eyelash holder 100 to position the prosthetic eyelash for application to the user's eyelid. The light 950 may provide additional illumination to perform this application, and the light 950 may be of various dimensions and configurations, which may include a configuration as a circular element inlaid in the upper surface of the base 730 around the mirror 940 and ringing the circumference of the base 730. The lower surface may be comprised of an anti-skid pad 997 covering a base plate 993 or it may simply be a base plate 993 with no anti-skid pad.

A touchscreen may be embedded in (or alternatively affixed to) the mirror 940 with an LED digital timer display 970, and the timer 960 may contain a stopwatch/timer function as well as the date and time, an illuminated logo or an inspirational or complimentary quote, phrase or word. The timer display 970 may be embedded in the base 730 so that it displays through the mirror 940 and the timer 960 may be haptically activated via a switch icon, also displayed on the mirror 940. Eyelash adhesive (or glue) requires time to partially dry for a predetermined period of time, usually 30 to 90 seconds, before applying the prosthetic eyelash to a user's eyelid. The glue cannot be so fluidly loose—that is, it cannot have so low a viscosity—that when applied to the eyelid the eyelash "slides" off, and the glue cannot cure to the point it will no longer adhere to the user's eyelid. The glue must become sticky to the touch, or tacky, during this semi-curing period, so that the prosthetic eyelash securely adheres to the user's eyelid. The timer 960 may thus be set to provide an alert to the user through a speaker 960 in the base 730 or via Bluetooth connectivity with the base 730 when the user-set timing period has expired and the prosthetic eyelash adhesive has cured to the user's desired point. At the expiration of timer 960, the user receives notification that the predetermined time has been reached and that the prosthetic eyelash is ready for positioning on the user's eyelid.

For clarity of explanation, the above description has focused on a representative sample of all possible embodiments, a sample that teaches the principles of the invention and conveys the best mode contemplated for carrying it out. The invention is not limited to the described embodiments. Well known features may not have been described in detail to avoid unnecessarily obscuring the principles relevant to the claimed invention. Throughout this application and its associated file history, when the term "invention" is used, it refers to the entire collection of ideas and principles described; in contrast, the formal definition of the exclusive protected property right is set forth in the claims, which exclusively control.

The description has not attempted to exhaustively enumerate all possible variations. Other undescribed variations or modifications may be possible. Where multiple alternative embodiments are described, in many cases it will be possible to combine elements of different embodiments, or to combine elements of the embodiments described here with other modifications or variations that are not expressly described. A list of items does not imply that any or all of the items are mutually exclusive, nor that any or all of the items are comprehensive of any category, unless expressly specified otherwise. In many cases, one feature or group of features may be used separately from the entire apparatus or methods described. Many of those undescribed alternatives, variations, modifications, and equivalents are within the literal scope of the following claims, and others are equivalent. The claims may be practiced without some or all of the specific details described in the specification. In many cases, method steps described in this specification can be performed in different orders than that presented in this specification, or in parallel rather than sequentially, or in different computers of a computer network, rather than all on a single computer.

I claim:

1. A holder for prosthetic eyelashes comprising:

a base, the base having a DC power source, a power on/off switch, a mirror, a light, a timer, a timer display, and a speaker wherein the power on/off switch includes an on setting and an off setting, wherein the on setting permits the power source to power each of the light, the timer, the timer display and the speaker;

a support rod removably attached to the base and having an adjustable length;

a swivel segment having a first end and a second end, wherein the swivel segment is fixedly attached to the support rod at the first end;

a spring, removably attached to the swivel segment at the second end;

a clamp fixedly attached to the spring, the clamp having two jaws and a closure linkage designed to retain and convey the jaws in and between an open conformation and a closed conformation, wherein each of the two jaws includes one or more articulated linkages permitting adjustment of a jaw curvature to conform to a desired curvature of a prosthetic eyelash, the two jaws further providing rigidity in a dimension permitting application of clamping force against the prosthetic eyelash, and wherein the spring is biased to urge the jaws into the closed conformation.

2. The holder for prosthetic eyelashes of claim 1, the swivel segment further comprising one or more ball joints, wherein the support rod is fixedly attached to one of the one or more ball joints.

3. The holder for prosthetic eyelashes of claim 1, the base further comprising a drawer.

4. The holder for prosthetic eyelashes of claim 1, the base further comprising a battery, wherein the DC power source is the battery.

5. The holder for prosthetic eyelashes of claim 1, wherein the DC power source is an AC-to-DC adaptor connected to an external AC power source.

6. The holder for prosthetic eyelashes of claim 1, wherein the each of the one or more articulated linkages is a disc-detent joint.

7. The holder for prosthetic eyelashes of claim 1, wherein the support rod is magnetically removably attached to the base and wherein the swivel segment is magnetically removably attached to the spring.

8. A holder for prosthetic eyelashes comprising:

a clamp having two jaws, a closure linkage designed to retain and convey the two jaws in and between an open conformation and a closed conformation, each of the two jaws having one or more articulated linkages, the articulated linkages designed to permit adjustment of a jaw curvature conforming to a desired curvature of a prosthetic eyelash, the two jaws further providing rigidity in a dimension for permitting an application of clamping force against the prosthetic eyelash;

a spring fixedly attached to each of the two jaws, the spring biased to urge the jaws into the closed conformation; and a stand, attached to the spring, the stand designed to hold the clamp in a working position for retention of the prosthetic eyelash for preparation of application to a human eyelid.

9. The holder for prosthetic eyelashes of claim 8, wherein the each of the one or more articulated linkages is a disc-detent joint.

10. The holder for prosthetic eyelashes of claim 8, the stand further comprising a base and a support rod, the base having a DC power source, a power on/off switch, a mirror, a light, a timer, a timer display, and a speaker, wherein the power on/off switch includes an on setting and an off setting, wherein the on setting permits the power source to power each of the light, the timer, the timer display and the speaker, and wherein the support rod is removably attached to the base and has an adjustable length.

11. The holder for prosthetic eyelashes of claim 10, the stand further comprising a swivel segment having a first end and a second end, wherein the swivel segment is fixedly attached to the support rod at the first end.

12. The holder for prosthetic eyelashes of claim 11, the swivel segment further comprising one or more ball joints, wherein the support rod is fixedly attached to one of the one or more ball joints.

13. The holder for prosthetic eyelashes of claim 11, wherein the spring is removably attached to the swivel segment.

14. The holder for prosthetic eyelashes of claim 13, wherein the support rod is magnetically removably attached to the base and wherein the swivel segment is magnetically removably attached to the spring.

15. The holder for prosthetic eyelashes of claim 10, the base further comprising a drawer.

16. The holder for prosthetic eyelashes of claim 10, the base further comprising a battery, wherein the DC power source is the battery.

17. The holder for prosthetic eyelashes of claim 10, wherein the DC power source is an AC-to-DC adaptor connected to an external AC power source.

18. A method for holding prosthetic eyelashes comprising:

associating a prosthetic eyelash with a clamp, wherein the clamp has two jaws and a closure linkage designed to retain and convey the two jaws in and between an open conformation and a closed conformation, each of the two jaws having one or more articulated linkages, the articulated linkages designed to permit adjustment of a jaw curvature conforming to a desired curvature of a prosthetic eyelash, the two jaws further providing rigidity in a dimension for permitting an application of clamping force against the prosthetic eyelash;

urging the two jaws into the closed conformation with a spring biased to apply a closing force; and attaching the spring to a stand, the stand designed for positioning the clamp into a working position for preparation of the prosthetic eyelash for application to a human eyelid.

19. The method for method for holding prosthetic eyelashes of claim 18, further comprising removably attaching the spring to the stand.

20. The method for method for holding prosthetic eyelashes of claim 19, further comprising magnetically removably attaching the spring to the stand.

* * * * *